US010722418B2

(12) United States Patent
Hyun et al.

(10) Patent No.: US 10,722,418 B2
(45) Date of Patent: Jul. 28, 2020

(54) ANKLE-LESS WALKING ASSISTANT APPARATUS AND METHOD FOR CONTROLLING THE SAME

(71) Applicant: HYUNDAI MOTOR COMPANY, Seoul (KR)

(72) Inventors: Dong Jin Hyun, Suwon-si (KR); Kyung Mo Jung, Seongnam-si (KR); Sang In Park, Suwon-si (KR); Hyun Seop Lim, Anyang-si (KR)

(73) Assignee: Hyundai Motor Company, Seoul (KR)

( * ) Notice: Subject to any disclaimer, the term of this patent is extended or adjusted under 35 U.S.C. 154(b) by 589 days.

(21) Appl. No.: 15/347,097

(22) Filed: Nov. 9, 2016

(65) Prior Publication Data

US 2017/0360644 A1 Dec. 21, 2017

(30) Foreign Application Priority Data

Jun. 15, 2016 (KR) ..... 10-2016-0074400

(51) Int. Cl.

| | |
|---|---|
| ***A61H 3/00*** | (2006.01) |
| ***A43B 3/00*** | (2006.01) |
| ***A61H 1/02*** | (2006.01) |

(52) U.S. Cl.

CPC ..... *A61H 3/00* (2013.01); *A43B 3/0005* (2013.01); *A61H 1/024* (2013.01); *A61H 1/0244* (2013.01); *A61H 2201/0165* (2013.01); *A61H 2201/1207* (2013.01); *A61H 2201/165* (2013.01); *A61H 2201/1623* (2013.01); *A61H 2201/50* (2013.01); *A61H 2201/5061* (2013.01); *A61H 2201/5069* (2013.01); *A61H 2201/5071* (2013.01); *A61H 2201/5097* (2013.01)

(58) Field of Classification Search

CPC ..... A61H 3/00; A61H 3/008; A61H 2003/007

See application file for complete search history.

(56) References Cited

U.S. PATENT DOCUMENTS

| | | | | |
|---|---|---|---|---|
| 2007/0056592 | A1* | 3/2007 | Angold | A61H 3/00 128/845 |
| 2008/0161937 | A1* | 7/2008 | Sankai | A61H 3/008 623/25 |

FOREIGN PATENT DOCUMENTS

| | | | |
|---|---|---|---|
| JP | 2014-068868 | A | 4/2014 |
| KR | 10-2005-0088695 | A | 9/2005 |
| KR | 10-0651639 | B1 | 11/2006 |
| KR | 10-1242517 | B1 | 3/2013 |
| KR | 10-1250324 | B1 | 4/2013 |
| KR | 10-1282859 | B1 | 7/2013 |

(Continued)

OTHER PUBLICATIONS

Office Action issued in corresponding Korean Patent Application No. 10-2016-0074400, dated Sep. 28, 2017.

*Primary Examiner* — Suba Ganesan

(74) *Attorney, Agent, or Firm* — Morgan, Lewis & Bockius LLP

(57) ABSTRACT

An ankle-less walking assistant apparatus includes: a body supporting the back of a wearer; left and right hip joint-drivers extending from both sides of the body; left and right thigh links having first ends connected to the left and right hip joint-drivers, respectively; left and right knee-drivers connected to second ends of the left and right thigh links, respectively; left and right calf links having first ends connected to the left and right knee-drivers, respectively; and ground-contact feet fixed to second ends of the left and right calf links, respectively.

15 Claims, 11 Drawing Sheets

(56) References Cited

FOREIGN PATENT DOCUMENTS

| | | | |
|---|---|---|---|
| KR | 10-1317354 | B1 | 10/2013 |
| KR | 10-1490885 | B1 | 2/2015 |

* cited by examiner

ANKLE-LESS WALKING ASSISTANT APPARATUS AND METHOD FOR CONTROLLING THE SAME

CROSS REFERENCE TO RELATED APPLICATION

The present application claims the benefit of priority to Korean Patent Application No. 10-2016-0074400, filed Jun. 15, 2016, the entire content of which is incorporated herein for all purposes by this reference.

TECHNICAL FIELD

The present disclosure relates to an ankle-less walking assistant apparatus and a method for controlling the same, and more particularly, to an ankle-less walking assistant apparatus without an ankle joint that can simplify a control algorithm and assists a wearer to more completely and naturally walk by removing discomfort of the wearer, and a method for controlling the ankle-less walking assistant apparatus.

BACKGROUND

An exoskeleton robot technology is a technology for ensuring mobility for the disabled and the elderly. However, the exoskeleton robot technology still accompanies various engineering issues in terms of mechanical design or operation algorithm. For example, in order to make an exoskeleton robot wearable as clothes, the mechanical parts of the robot are severely limited in terms of available space or weight.

Further, a control sampling of the entire robot should be fast enough to appropriately respond to external force from the surroundings without interfering with the motion of a human user.

Many robot developers have obtained successive results up to now in the performance of wearable robots, but there is a need for much improvement in the control algorithm for wearable robots.

In the related art, particularly wearable robots having ankle joints and feet that are connected to the ankle joints have generally been developed. However, an ankle and a foot play a very important role in exoskeleton robots that sense and process physical interaction with the ground, but it is very difficult to appropriately design ankles and feet. That is, the human ankle is very complicated, so it is difficult to give the degree of freedom, which is high enough without interfering with movement of the wearer, to the ankles of wearable robots. Further, the ankle is increased in weight to be able to resist frequency shock from the ground. Further, in order to measure ground reaction force (GRF) using a force/torque sensor, it is required to strongly support a foot module, so inelastic shock to the ground is generated, which causes unnatural walking of the robot wearer.

The foregoing is intended merely to aid in the understanding of the background of the present disclosure, and is not intended to mean that the present disclosure falls within the purview of the related art that is already known to those skilled in the art.

SUMMARY

The present disclosure has been made keeping in mind the above problems occurring in the related art, and the present disclosure is intended to propose an ankle-less walking assistant apparatus without an ankle joint, whereby the apparatus can simplify a control algorithm and assists a wearer to more completely and naturally walk by removing discomfort of the wearer, and a method for controlling the apparatus.

According to an embodiment in the present disclosure, an ankle-less walking assistant apparatus that includes: a body supporting the back of a wearer; left and right hip joint-drivers extending from both sides of the body; left and right thigh links having first ends connected to the left and right hip joint-drivers, respectively; left and right knee-drivers connected to second ends of the left and right thigh links, respectively; left and right calf links having first ends connected to the left and right knee-drivers, respectively; and ground-contact feet fixed to second ends of the left and right calf links, respectively.

The body may include: pressure sensors sensing pressure on soles of both feet of a wearer; and a controller determining gait phases of a leg to be controlled and the other leg on the basis of the pressure sensed by the pressure sensors, selecting one of a plurality of control modes set in advance on the basis of the determined gait phases, and controlling the hip joint-driver and the knee-driver for the leg to be controlled.

The pressure sensor may include a plurality of pressure sensors for detecting pressure applied to the toes and the heels of the soles.

The pressure sensor may include a first pressure sensor sensing pressure applied to the toe and a second pressure sensor sensing pressure applied to the heel.

The controller may determine that the toes and the heels are in contact with the ground when pressure applied to the toes and the heels is larger than a threshold, and may determine that the toes and the heels are not in contact with the ground when the pressure is smaller than the threshold.

The controller may determine as a gait phase that a corresponding leg is supported on the ground throughout the sole when the toe is in contact with the ground and the heel is in contact with the ground, may determine as a gait phase that a corresponding leg is supported on the toe on the ground when the toe is in contact with the ground and the heel is not in contact with the ground, may determine as a gait phase that a corresponding leg is supported on the heel on the ground when the toe is not in contact with the ground and the heel is in contact with the ground, and may determine as a gait phase that a corresponding leg is in the air when both the toe and the heel are not in contact with the ground.

The controller may determine one of a weight bearing mode, a compensation of mechanical impedance mode, a ground impact absorbing mode, a ground impact absorbing & extension of virtual leg mode, a pushing ground mode, and a ready for swing phase mode, as a control mode for the leg to be controlled on the basis of the gait phases of both the leg to be controlled and the other leg.

The weight bearing mode may be a mode in which the controller controls the hip joint-drivers and the knee-drivers to push the wearer in a gravity direction with a force.

The compensation of mechanical impedance mode may be a mode in which the controller controls the hip joint-drivers and the knee-drivers to compensate for friction at the joints and weight of the robot due to the gravity.

The ground impact absorbing mode may be a mode in which the controller makes a virtual spring-damper in a longitudinal direction of a line connecting a hip joint and an end of the leg to each other of the walking assistant robot and controls the hip joint-driver and the knee-driver, using impedance control in order to make the leg of the robot absorb shock from the outside.

The ground impact absorbing & extension of virtual leg mode may be a mode in which the controller sets a balance point in an impedance control direction for the virtual legs as 0 degrees and controls the hip joint-driver and the knee-driver so that the virtual leg is pulled to be vertically erected while making a virtual spring-damper in a longitudinal direction of a line connecting a hip joint and the end of the leg to each other of the walking assistant robot and controlling the hip joint-driver and the knee-driver, using impedance control in order to make the leg of the robot absorb shock from the outside.

The pushing ground mode may be a mode in which the controller controls the hip joint-driver and the knee-driver to push the end of the leg to be controlled in −x and −y directions in a rectangular coordinate system (a front direction of the robot is +x direction and a direction vertically going away from the ground is +y direction in the rectangular coordinate system).

The ready for swing phase mode may be a mode in which the controller controls the hip joint-driver and the knee-driver to push the end of the leg to be controlled in +x and +y directions in a rectangular coordinate system for easy swing of the leg (a front direction of the robot is +x direction and a direction vertically going away from the ground is +y direction in the rectangular coordinate system).

When the control mode changes, the controller may apply a transition parameter, which changes from 0 to 1 along a sinusoidal path for a predetermined time interval, to control torque applied to the hip joint-driver and the knee-driver in a previous control mode and to control torque to be applied to the hip joint-driver and the knee-driver in a new changed control mode.

Each of the ground-contact feet may have a curved surface, which is curved away from the ground in a walking direction, at a portion that comes in contact with the ground.

Each of the ground-contact feet may include a rubber sole at the portion that comes in contact with the ground.

According to another aspect of the present invention, there is provided a method for controlling an ankle-less walking assistant apparatus that includes: a body supporting the back of a wearer; left and right hip joint-drivers extending from both sides of the body; left and right thigh links having first ends connected to the left and right hip joint-drivers, respectively; left and right knee-drivers connected to second ends of the left and right thigh links, respectively; left and right calf links having first ends connected to the left and right knee-drivers, respectively; ground-contact feet fixed to second ends of the left and right calf links, respectively; and pressure sensors disposed on soles of both legs of the wearer, The method comprising: sensing pressure on the soles of the feet of the wearer by means of a pressure sensor; determining gait phases of both a leg to be controlled and the other leg on the basis of the pressure sensed by the pressure sensor by means of a controller; and selecting one of a plurality of control modes set in advance on the basis of the determined gait phases, and controlling the hip joint-driver and the knee-driver of the leg to be controlled by means of the controller.

According to the ankle-less walking assistant apparatus and a method for controlling the ankle-less walking assistant apparatus of various exemplary embodiments of the present invention, since ground-contact feet for supporting the ground are fixed to the ends of the calf links without a drivers for driving ankle joints, it is required to control drivers for the ankles of an exoskeleton robot, so the control algorithm can be simplified. Further, it is possible to remove the parts corresponding to ankle-drivers and feet connected the ankle-drivers from a robot, thus wearer discomfort due excessive weight of the robot and restrictions in the degree of freedom when the robot is worn is removed, so the wearer can more easily walk.

Further, according to the ankle-less walking assistant apparatus and a method for controlling the ankle-less walking assistant apparatus, it is possible to simply determine the gait phases of both a leg to be controlled and the other leg in accordance with load applied to the toe and the heel of the feet. Further, determined gait phases and predetermined walking modes are matched and then legs are controlled, so it is possible to ensure excellent walking assistance performance without a complicated calculation process.

Further, according to the walking assistant apparatus and the method for controlling the ankle-less walking assistant apparatus, since it is possible to determine walking assistant force through simple Jacobian transform regardless of the number of axes, the applicable range is very wide.

BRIEF DESCRIPTION OF THE DRAWINGS

The above and other objects, features and other advantages of the present disclosure will be more clearly understood from the following detailed description when taken in conjunction with the accompanying drawings.

DETAILED DESCRIPTION

Ankle-less walking assistant apparatus and a method of controlling the wearable walking assistant robot according to various embodiments in the present disclosure will be described hereafter with reference to the accompanying drawings.

Figure 1:
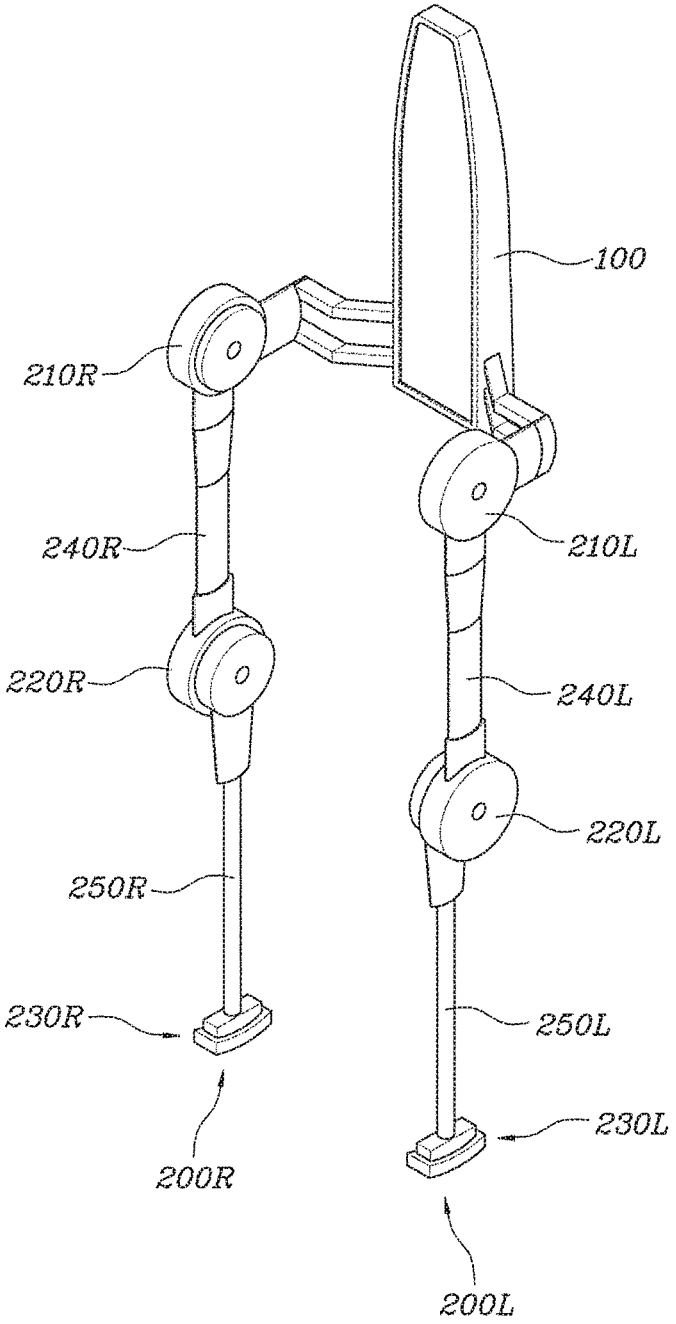
FIGS. 1 to 3 are a perspective view, a rear view, and a side view, respectively, showing an ankle-less walking assistant apparatus according to an embodiment in the present disclosure.
Figure 2:
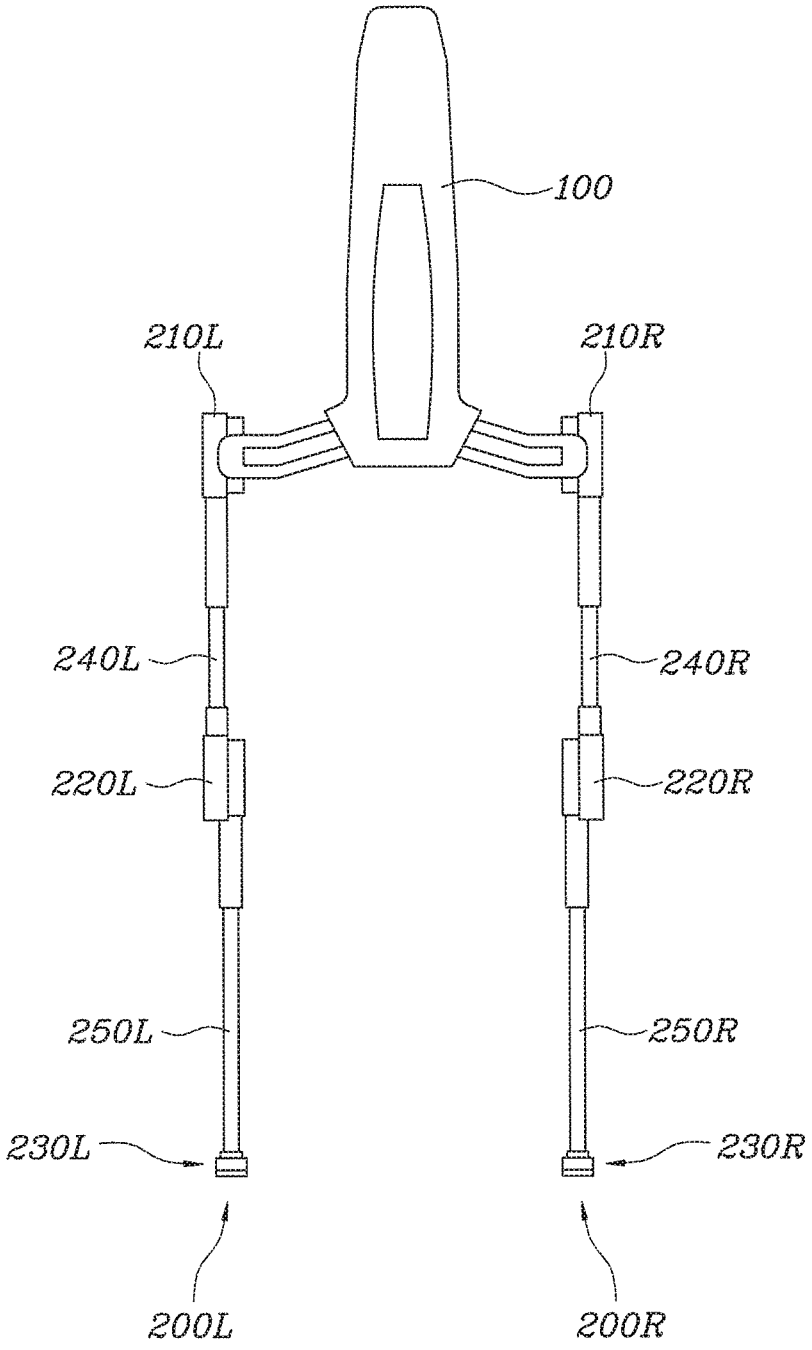
Figure 3:
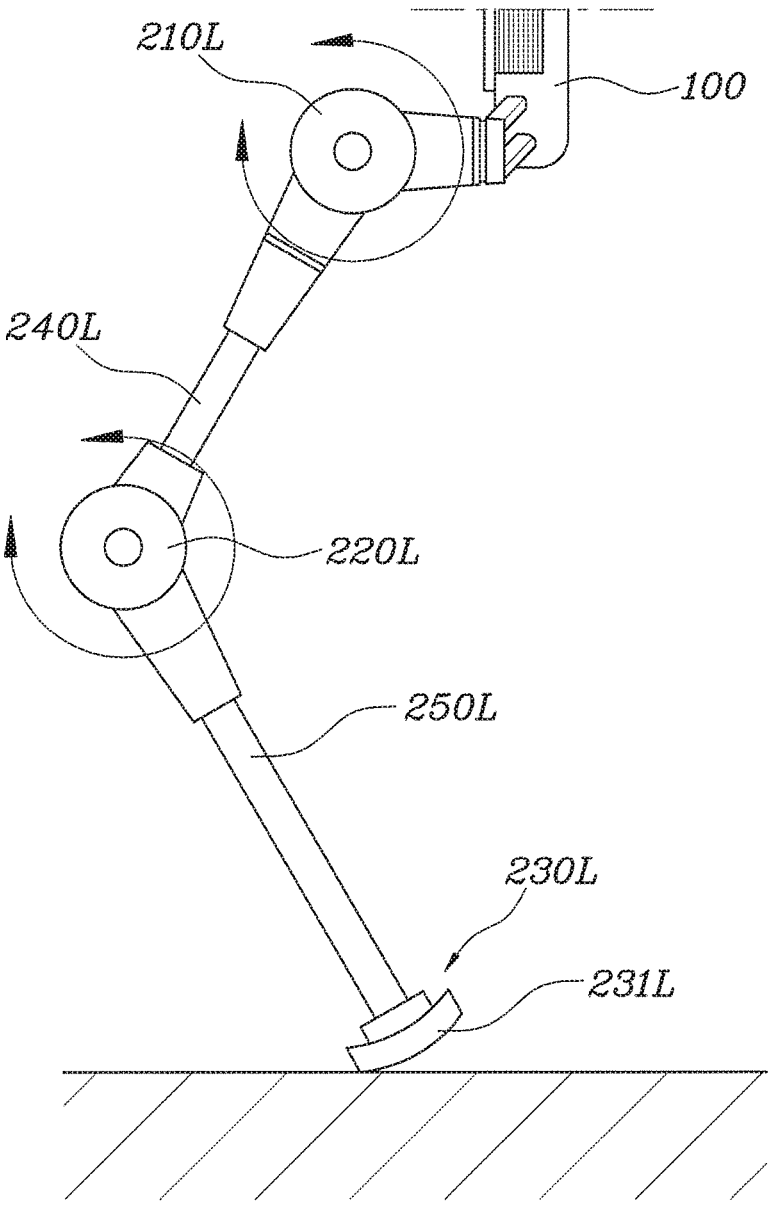

FIGS. 1 to 3 are a perspective view, a rear view, and a side view, respectively, showing an ankle-less walking assistant apparatus according to an embodiment in the present disclosure.

Referring to FIGS. 1 to 3, an ankle-less walking assistant robot according to an embodiment in the present disclosure may include a body 100 supporting the wearer's back and legs 200R and 200L extending from the body 100.

The legs 200L and 200R may respectively include hip joint-drivers 210L and 210R extending from both sides of the body 100, thigh links 240L and 240R each having first ends connected to the hip joint-drivers 210L and 210R, knee-drivers 220L and 220R connected to second ends of the thigh links 240L and 240R, calf-drivers 250L and 250L having first ends connected to the knee-drivers 220L and 220R, and ground-contact feet 230L and 230R fixed to second ends of the calf links 250L and 250R.

The ankle-less walking assistant robot according to an embodiment of the present invention is characterized by fixing the ground-contact feet 230L and 230R for supporting the ground to the ends of the calf links 250L and 250R without a driver for knee joints.

Accordingly, it is not required to control a knee-driver of an exoskeleton robot, so it is possible to simplify the control algorithm. Further, it is possible to remove a knee-driver and parts corresponding to feet which are connected to the knee-driver in a robot, so it is possible to enable a wearer to more naturally walk by removing discomfort in walking of the wearer due to the robot weight and limitations in degree of freedom caused by wearing the robot.

The body 100 can physically support the wearer's back by being disposed on the back. Though not shown in the drawings, the body 100 may be fastened to the wearer's back by shoulder bands etc. The body 100 ensures a space inside so that several parts for controlling the apparatus are disposed in the space.

For example, the body 100 may include a controller that controls the entire apparatus, a driver integrated circuit (IC) that operates drivers for joints, an inertial sensor that detects inclination (pitch) of the body 100, and a battery that supplies power to various parts of the robot.

The legs 200L and 200R are fastened to the legs of a wearer between the body 100 and the ground, and as drivers at joints of the legs 200L and 200R are operated, the legs can assist walking of the wearer.

As described above, the legs 200L and 200R may respectively include hip joint-drivers 210L and 210R extending from both sides of the body 100, thigh links 240L and 240R each having first ends connected to the hip joint-drivers 210L and 210R, knee-drivers 220L and 220R connected to second ends of the thigh links 240L and 240R, calf-drivers 250L and 250L having first ends connected to the knee-drivers 220L and 220R, and ground-contact feet 230L and 230R fixed to second ends of the calf links 250L and 250R.

The hip joint-drivers 210L and 210R and the knee-drivers 220L and 220R, which are controlled to operate by a controller, may be motors or actuators that generate torque by converting electrical energy into rotational energy. The hip joint-drivers 210L and 210R and the knee-drivers 220L and 220R may each include an encoder for detecting a rotational angle and the controller can control the hip joint-drivers 210L and 210R and the knee-drivers 220L and 220R on the basis of feedback of the rotational angle detected by the encoder.

The thigh links 240L and 240R are disposed between the hip joint-drivers 210L and 210 R and the knee-drivers 220L and 220R, and the calf links 250L and 250R are connected to the second ends of the knee-drivers 220L and 220R. Though not shown in the drawings, fastening members such as a harness may be provided at the thigh links 240L and 240R and the calf links 250L and 250R to fasten them to the wearer's legs.

Further, the thigh links 240L and 240R and the calf links 250L and 250R may have an elastic member such as a spring for absorbing shock that is generated when the wearer walks, and length adjusters for adjusting the lengths of the elastic members to fit to the size of the wearer may be provided.

The ground-contact feet 230L and 230R are fixed to the ends of the calf links 250L and 250R. That is, the ground-contact feet 230L and 230R are fixed directly to the ends of the calf links 250L and 250R without a specific component of a joint.

The ground-contact feet 230L and 230R have a curved surface that is curved away from the ground on the bottoms so that the wearer can smoothly move on the ground between the contact point and the separation point on the bottom while walking.

Further, the ground-contact feet 230L and 230R has a rubber sole 231L on the portion that comes in contact with the ground, so it is possible to increase contact force with the ground and absorb shock from the ground.

The ankle-less walking assistant apparatus according to an embodiment in the present disclosure may further include, in order to control the operation of an exoskeleton robot, may further include a pressure sensor 30 (see FIG. 4) that senses pressure applied to soles of both feet of a wearer, and a controller 400 (see FIG. 4) that determines the gait phases of a leg to be controlled and the other leg on the basis of the pressure sensed by the pressure sensor, selects any one of a plurality of control modes set in advance on the basis of the determined gait phases, and controls the hip joint-drivers 210L and 210R and the knee-drivers 220L and 220R for the leg to be controlled.

Figure 4:
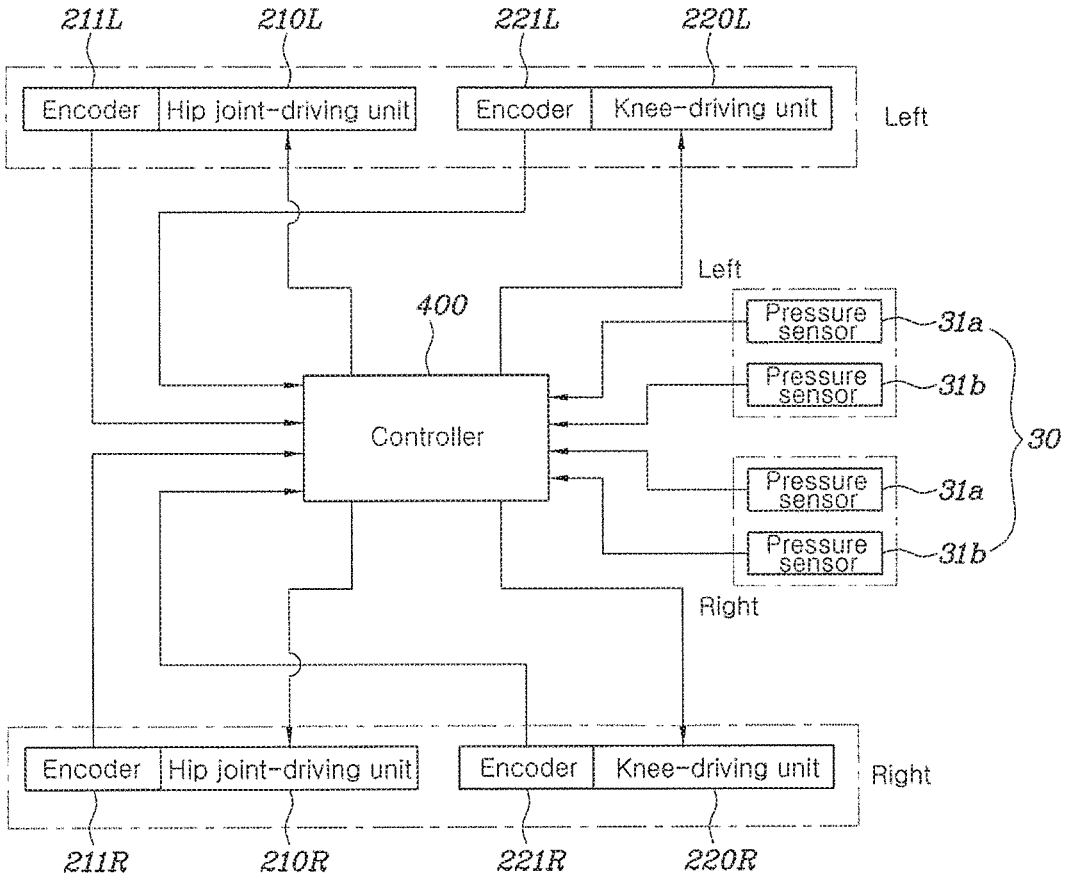
FIG. 4 is a block diagram illustrating a control flow of an ankle-less walking assistant apparatus according to an embodiment in the present disclosure.

FIG. 4 is a block diagram illustrating a control flow of an ankle-less walking assistant apparatus according to an embodiment in the present disclosure.

Referring to FIG. 4, an ankle-less walking assistant robot according to an embodiment in the present disclosure may include a pressure sensor 30 that senses pressure on the soles of feet of a wearer and a controller 400 that determines gait phases of both a leg to be controlled and the other leg on the basis of the pressure sensed by the pressure sensor 30, selects one of a plurality of control modes set in advance on the basis of the determined gait phases, and controls the hip joint-drivers 210L and 210R and the knee-drivers 220L and 220R for the leg to be controlled.

Figure 5A:
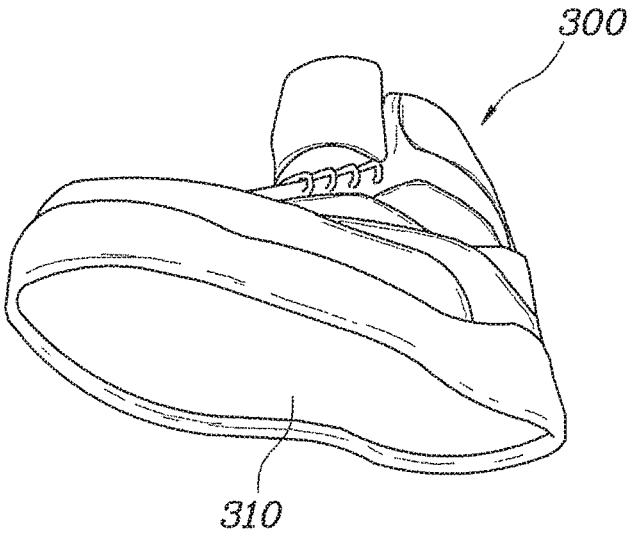
FIGS. 5A and 5B are views showing a pressure sensor for an ankle-less walking assistant apparatus according to an exemplary embodiment in the present disclosure.
Figure 5B:
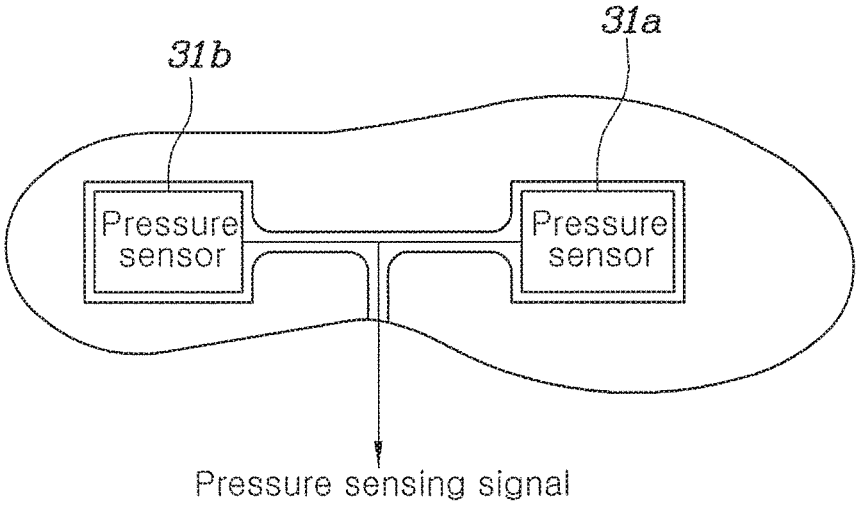

FIGS. 5A and 5B are views showing a pressure sensor for an ankle-less walking assistant apparatus according to an exemplary embodiment in the present disclosure.

As shown in FIGS. 5A and 5B, the pressure sensor 30 that is applied to the ankle-less walking assistant robot according to an exemplary embodiment in the present disclosure may include a plurality pressure sensors 31*a* and 31*b* that is disposed on the bottom 310 of a shoe 300 (for example, on the sole of a shoe) to detect pressure applied to the sole.

In the present disclosure, the pressure sensor 30 may include a first pressure sensor 31*a* positioned close to the toe and a second pressure sensor 31*b* positioned close to the heel.

The arrangement of the pressure sensor 30 is applied to both feet of the robot wearer.

The embodiment shown in FIGS. 5A and 5B is an example illustrating two pressure sensors 31*a* and 31*b* attached to a shoe of a robot wearer, but various modifications may be considered, for example, three or more pressure sensors may be applied or pressure sensors may be disposed on a sole support member of a robot instead of the shoe of a robot wearer. Further, the pressure sensors 31*a* and 31*b* and the controller 400 are connected by wires (not shown), so sensing information may be transmitted to the controller 400 from the pressure sensors 31*a* and 31*b* or sensing information may be transmitted to the controller 400 from the pressure sensors 31*a* and 31*b* by wire or wireless communication known in the art.

The controller 400 receives signals from the pressure sensor 30 sensing pressure on both soles of a robot wearer, determines gait phases of both a leg to be controlled and the other leg on the basis of the sensed pressure, selects one of a plurality of control modes set in advance on the basis of the determined gait phases, and controls the hip joint-drivers 210L and 210R and the knee-drivers 220L and 220R of the leg to be controlled.

In detail, the controller 400 can receive signals from the pressure sensor 30 sensing the pressure on both soles and can determine gait phases of the legs in accordance with to which one of the toe and the heel of the soles pressure is applied. For example, the portion to which pressure is applied may be the toe and/or the heel of a foot, so the controller 400 can determine gait phases of both legs in a total of four cases for one sole.

Further, the controller 400 can control the hip joint-drivers 210L and 210R and the knee-drivers 220L and 220R on the basis of the gait phases determined for the legs. To this end, the controller 400 can determine in advance and keep control modes for the gait phases of both the leg to be controlled and the other leg, and selects control modes for the gait phases of both the leg to be controlled and the other leg and controls the hip joint-drivers 210L and 210R and the knee-drivers 220L and 220R of the leg to be controlled, thereby providing force for assisting walking.

The control technique of the controller 400 may be more clearly understood from the following description about the method for controlling an ankle-less walking assistant robot according to various embodiments in the present disclosure.

Figure 6:
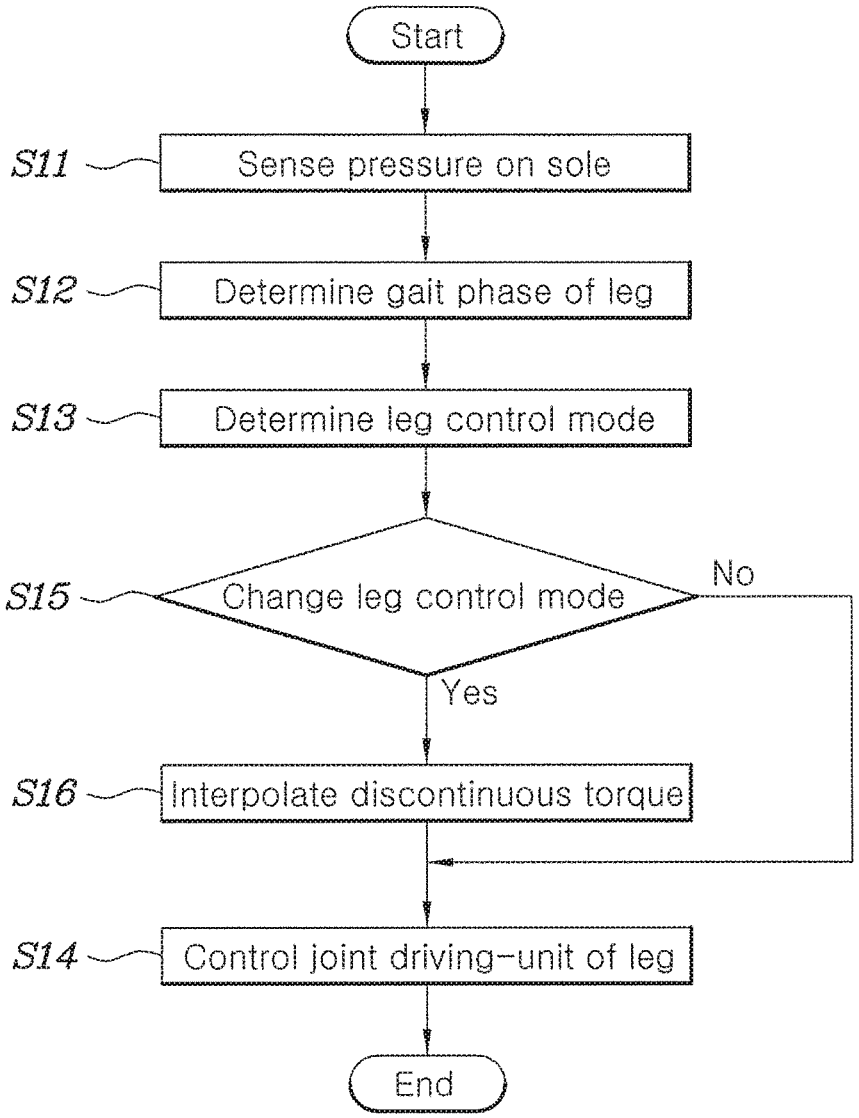
FIG. 6 is a flowchart illustrating a method for controlling an ankle-less walking assistant apparatus according to an exemplary embodiment in the present disclosure.

FIG. 6 is a flowchart illustrating a method of controlling an ankle-less walking assistant apparatus according to an exemplary embodiment in the present disclosure.

Referring to FIG. 3, a method for controlling an ankle-less walking assistant apparatus according to the present disclosure includes: sensing pressure applied to the soles of a wearer by means of the pressure sensor 30 (S11); determining gait phases of both a leg to be controlled and the other leg on the basis of the pressure sensed by the pressure sensor (S12) by means of the controller 400; selecting one of a plurality of control modes set in advance on the basis of the determined gait phases by means of the controller 400 (S13); and controlling the hip joint-drivers 210L and 210R and the knee-drivers 220L and 220R of the leg to be controlled by means of the controller 400 (S14).

First, the sensing of pressure on feet (S11) is a step of detecting pressure at the toe and the heel of each sole of a wearer using the pressure sensor 30, as described with reference to FIGS. 5A and 5B. For example, a total of four sensing signals may be provided to the controller 400 by two first pressure sensors 31*a* for sensing the pressure at the toe of each sole and two second pressure sensors 31*b* for sensing the pressure at the heel of each sole.

In the determining of gait phases (S12), the controller 400 determines gait phases corresponding to the soles on the basis of the four sensing signals.

The following table 1 shows an example that the controller 400 determines gait phases of legs on the basis of the results of sensing pressure on a sole.

TABLE 1

| Gait phase | First pressure sensor (toe) | Second pressure sensor (heel) |
|---|---|---|
| air | non-contact | non-contact |
| heel-strike | non-contact | contact |
| support | contact | contact |
| toe-off | contact | non-contact |

As disclosed in the table, the controller 400 can determine the gait phases for each leg as an air state, a heel-strike state, a support state, and a toe-off state.

Determination of the gait phases may depend on the intensity of the sensing signals from the first pressure sensor 31*a* and the second pressure sensor 11*b* and this determination technique is described below with reference to FIGS. 7A-7D.

FIGS. 7A-7D are views showing an example of sensing signals from a pressure sensor of an ankle-less walking assistant apparatus according to an exemplary embodiment in the present disclosure.

Figure 7A:
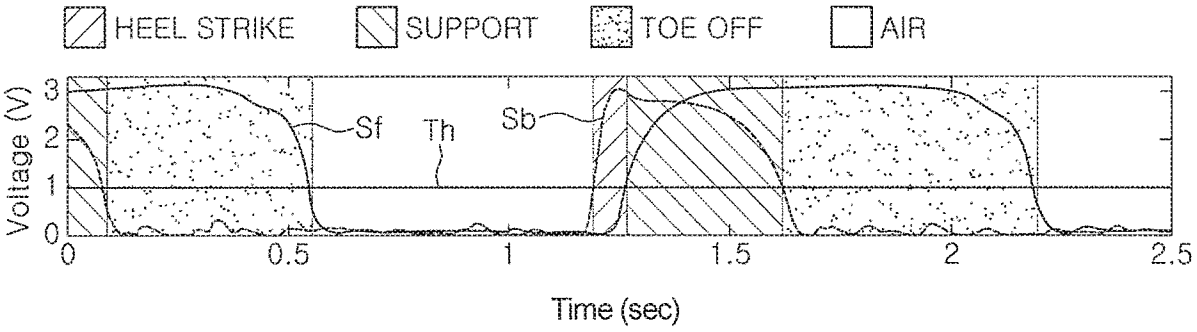
FIGS. 7A-7D are views showing an example of sensing signals from a pressure sensor of an ankle-less walking assistant apparatus according to an exemplary embodiment in the present disclosure.
Figure 7B:
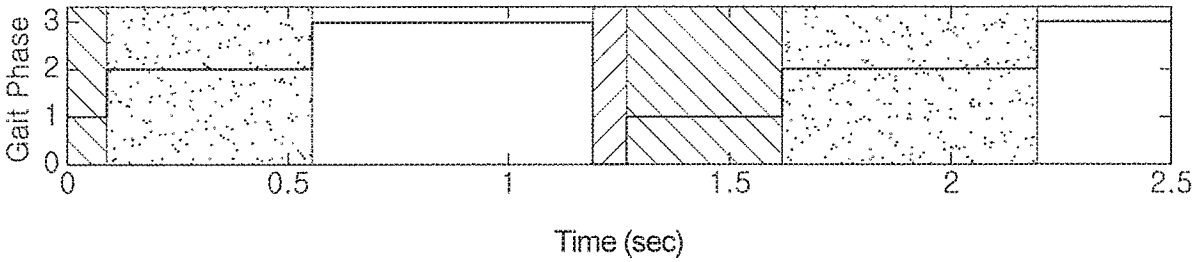
Figure 7C:
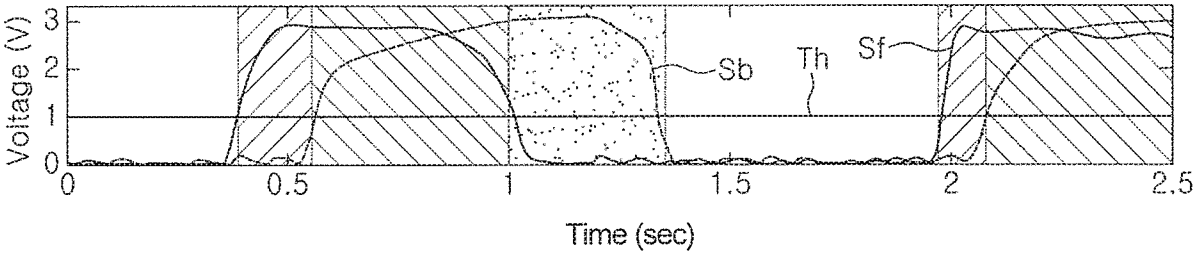
Figure 7D:
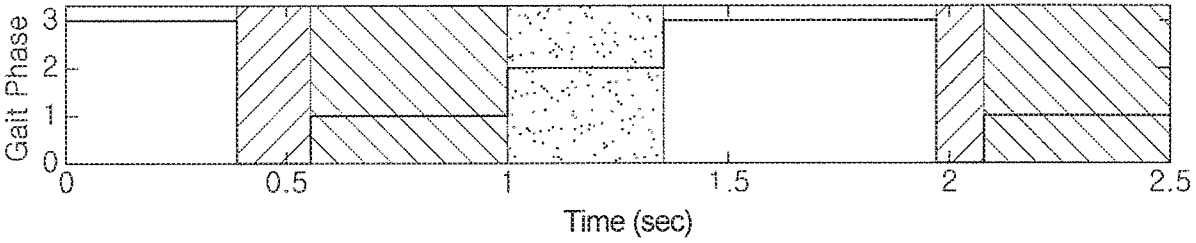

As shown in FIGS. 7A-7D, in which FIGS. 7A and 7B are for left leg and FIGS. 7C and 7D are for right leg, the first pressure sensor 31*a* and second pressure sensor 31*b* on the left sole and the first pressure sensor 31*a* and the second pressure sensor 31*b* on the right sole can output voltages corresponding to the intensity of sensed pressure as sensing signals. The controller 400 compares the intensity of the sensing signals from the pressure sensors with a threshold Th set in advance, may determine that the portions corresponding to corresponding sensors are in contact with the ground when the sensing signals are larger than the threshold Th, and may determine that the portions (the toe and the heel) corresponding to corresponding pressure sensors are not in contact with the ground when the sensing signals are smaller than the threshold Th.

Accordingly, the controller 400 can determine the gait phases of the legs of the soles, as in the table, in accordance with whether the toes and the heels of the feet are in contact with the ground sensed by the first pressure sensors 31*a* and the second pressure sensors 31*b*.

When the gait phases of the legs are determined, the controller 400 can determine the control modes for the legs (S13). The controller 400 can control a leg by determining one of a plurality of control modes set in advance, on the basis of the gait phases of both the leg to be controlled and the other leg.

Figure 8:
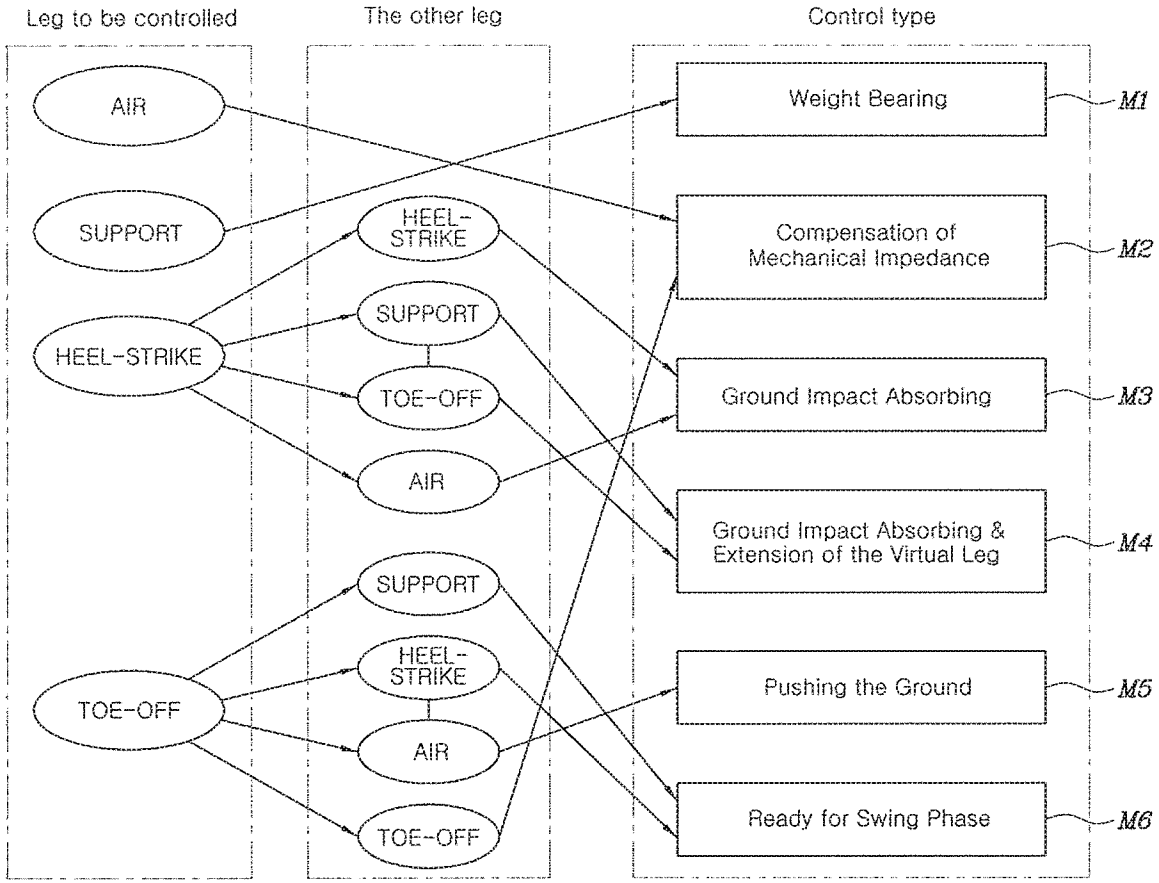
FIG. 8 is a view showing an example of determining control modes on the basis of gait phases of legs in an ankle-less walking assistant apparatus according to an exemplary embodiment in the present disclosure.

FIG. 8 is a view showing an example of determining control modes on the basis of gait phases of legs in an ankle-less walking assistant apparatus according to an exemplary embodiment in the present disclosure.

Referring to FIG. 8, the controller 400 can select one of a total of six control modes in accordance with the gait phases of both the leg to be controlled and the other leg. The six control modes may be determined in advance.

In the present disclosure, the six control modes may include a "weight bearing mode" M1, a "compensation of mechanical impedance mode" M2, a "ground impact absorbing mode" M3, a "ground impact absorbing & extension of virtual leg mode" M4, a "pushing ground mode" M5, and a "ready for swing phase mode" M6.

For example, when the left leg is in the heel-strike state and the right leg is the support state, the controller 400 can control the left leg in the "ground impact absorbing & extension of virtual leg mode" M4 and the right leg in the "weight bearing mode" M1.

In the present disclosure, when the leg to be controlled is in the air state and the support state, the "compensation of mechanical impedance mode" M2 and the "weight bearing mode" M1 are determined regardless of the gait phase of the other leg, and in other cases, the control mode can be determined in accordance with the state of the other leg.

The "weight bearing mode" M1 of the six control modes is a mode for controlling torque of the hip joint-drivers 210L and 210R and the knee-drivers 220L and 220R (for example, actuators) disposed at joints to push the wearer in the gravity direction (for example, perpendicularly to the ground) with a desired force set in advance. For example, a body, thighs, and claves are sequentially connected through joints in common walking assistant robots. The body 100 and thighs are connected through the hip joint-drivers 210L and 220R, and the thigh links 240L and 240R and the calf links 250L and 250R are connected through the knee-drivers 220L and 220R. An inertial sensor may be disposed on the body 100 and sense the pitch angle of the body 100, while encoders 211L, 211R, 221L, and 221R are disposed on the hip joint-drivers 210L and 210R and the knee-drivers 220L and 220R, respectively, so the rotational angles of the joints can be sensed. The controller 400 can estimate the direction of gravity from the sensing information.

The controller 400 can create a Jacobian composed of an inertial sensor, a hip joint rotation angle, and a knee joint rotation angle and control the drivers of the joints to push the ground with a predetermined force in the gravity direction.

Next, the compensation of mechanical impedance mode M2 is provided to compensate for mechanical friction or weight of the walking assistant robot. For example, the compensation of mechanical impedance mode M2 is a mode in which the controller 400 controls the hip joint-drivers 210L and 210R and the knee-drivers 220L and 220R to compensate for friction at the joints and the weight of links for the body, thighs, and calves of the walking assistant robot. The compensation of mechanical impedance mode M2 is a mode that enables a wearer to easily move his/her legs without feeling the weight of the legs or friction of the walking assistant robot.

Next, the ground impact absorbing mode M3 is a mode for making the legs of the walking assistant robot absorb shock from the outside, in which the controller 400 makes virtual spring-dampers in the longitudinal directions of virtual legs (lines from the hip joints to the ends of the robot legs) and controls the drivers for the joints, using impedance control. The virtual legs are lines from the hip joints to the ends of the legs of the walking assistant robot and the controller 400, in the ground impact absorbing mode M3, creates virtual spring-dampers in the lines corresponding to the virtual legs, thereby absorbing shock from the outside.

Next, the ground impact absorbing & extension of virtual leg mode M4 is a mode in which the controller 400 sets a balance point in the impedance control direction for the virtual legs as 0 degrees and additionally pulls the virtual legs so that the legs are vertically erected while performing the mode M3.

Next, the pushing ground mode M5 is a mode that is performed when the legs are in a delayed stance phase, in which the controller 400 pushes the upper body by controlling the drivers for the joints to push the ends of the legs (the ground-contact feet 230L and 230R) in −x and −y directions.

Finally, the ready for swing phase mode M6 is a mode in which the controller 400 controls the drivers for the joints to push the ends of the legs in +x and +y directions so that the wearer can easily swing the legs.

A technique of actually applying the control modes M1 to M6 to the robot is described in more detail hereafter.

Figure 9:
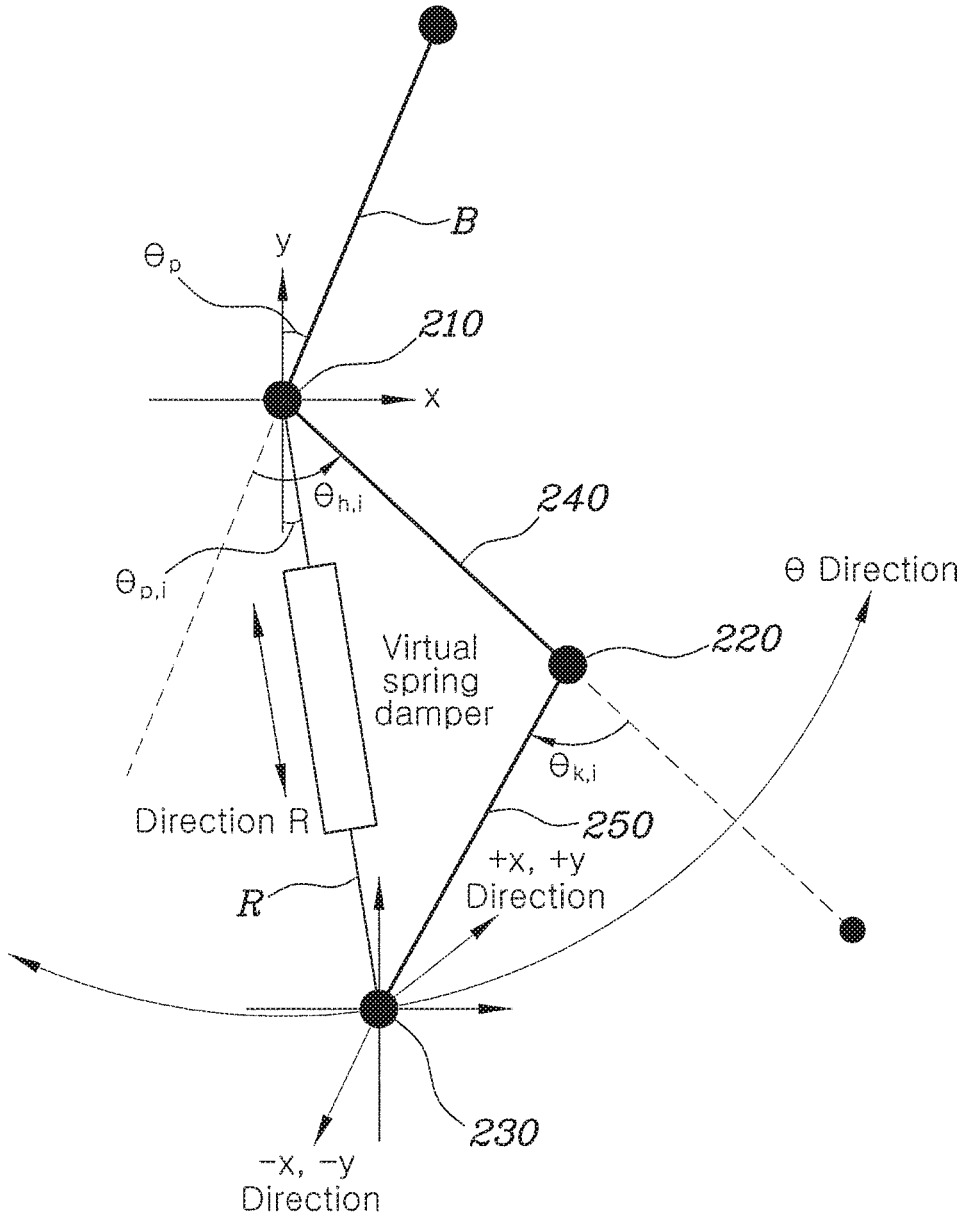
FIG. 9 is a view simply showing the operation of a robot of an ankle-less walking assistant apparatus according to an embodiment in the present disclosure.

FIG. 9 is a view simply showing an example of a robot of an ankle-less walking assistant apparatus according to an embodiment in the present disclosure. As described above, since the body 100 has an inertial sensor (IMU: Inertial Measurement Unit), the pitch angle of the body 100 can be sensed, and the encoders (211L, 211R, 221L, and 221R in FIG. 4) that sense the rotational angles of the joints and the hip joint-drivers 210 (210L+210R) and the knee-drivers 220 (220L+220R) (for example, actuators), which are operated by the controller 400, may be disposed at the hip joints and the knee joints. The pitch angle of the body 100 sensed by the inertial sensor and the rotational angles of the joints sensed by the encoders (211L, 211R, 221L, and 221R) are provided to the controller 400.

Referring to FIG. 9, the ends of legs (the ground-contact feet 230L and 230R in an embodiment of the present invention) can be located with respect to the positions of the hip joints in a rectangular coordinate system, as in the following Equation 1

$$E_{c,i} = \begin{bmatrix} L_1\sin(\theta_{h,i} - \theta_p) + L_2\sin(\theta_{h,i} - \theta_p - \theta_{k,i}) \\ -L_1\cos(\theta_{h,i} - \theta_p) - L_2\cos(\theta_{h,i} - \theta_p - \theta_{k,i}) \end{bmatrix} \quad \text{[Equation 1]}$$

where $L_1$ is the length of the thigh links 240L and 240R, $L_2$ is the length of the calf links 250L and 250R, $\theta_p$ is the pitch angle of the body 100, $\theta_h$ is the rotational angle of the hip joint-drivers 210L and 210R, and $\theta_k$ is the rotational angle of the knee joint-driving angles 220L and 220R. Further, the subscript i means the right leg.

Further, the ends 230L and 230R of the legs can be located in a polar coordinate system as in the following Equation 2, using Equation 1.

$$E_{p,i} = \begin{bmatrix} R_{p,i} \\ \theta_{p,i} \end{bmatrix} = \begin{bmatrix} \sqrt{E_{x,i}^2 + E_{y,i}^2} \\ tan^{-1}\dfrac{E_{x,i}}{E_{y,i}} \end{bmatrix} \quad \text{[Equation 2]}$$

A Cartesian Jacobian and a polar Jacobian based on the hip joint can be obtained from Equations 1 and 2, as in the following Equations 3 and 4.

$$J_{c,i} = \frac{\partial E_{c,i}}{\partial \overline{q}} \quad \text{[Equation 3]}$$

$$J_{p,i} = \frac{\partial E_{p,i}}{\partial \overline{q}}, \quad \text{[Equation 4]}$$

where $\overline{q}$ is the rotational angles of the joints sensed by the encoders 211L, 211R, 221L, and 221R, which can be expressed as $\overline{q}=[\theta_{h,i}\ \theta_{k,i}]^T$.

Accordingly, the speed at the ends 230L and 230R of the legs can be calculated in a rectangular coordinate system and a polar coordinate system, using the Jacobians, as in the following Equations 5 and 6.

$$\dot{E}_{c,i} = J_{c,i}\begin{bmatrix} \dot{\theta}_{h,i} \\ \dot{\theta}_{k,i} \end{bmatrix} \quad \text{[Equation 5]}$$

-continued $$\dot{E}_{p,i} = J_{p,i}\begin{bmatrix}\dot{\theta}_{h,i}\\ \dot{\theta}_{k,i}\end{bmatrix} \quad \text{[Equation 6]}$$

The control modes M1 to M6 can be induced as follows, using the Jacobians induced as described above.

The "weight bearing mode" M1, the "pushing ground mode" M5, and the "ready for swing phase mode" M6 are performed by feedfoward control for directly providing force in the x-axial and/or y-axial direction, so the following Equation 7 can be obtained.

$$\begin{bmatrix}\tau_{h,i}\\ \tau_{k,i}\end{bmatrix} = J_{c,i}^{T}\begin{bmatrix}F_x\\ F_y\end{bmatrix}, \quad \text{[Equation 7]}$$

In Equation 7, $\Sigma_{h,I}$ and $\tau_{k,i}$ are torque at the hip joint-drivers 210L and 210R and the knee-drivers 220L and 220R, respectively, $F_x$ are $F_y$ are force set in advance to be applied to the ends of the legs in the "weight bearing mode" M1, the "pushing ground mode" M5, and the "ready for swing phase mode" M6.

For example, force is supposed to be applied only in the −y-axial direction in the "weight bearing mode" M1, so $F_x$ is 0 and $F_y$ may have a predetermined negative value. Further, force is supposed to be applied in the −x and −y directions in the "pushing ground mode" M5, so $F_x$ and $F_y$ both may have predetermined negative values, while force is supposed to be applied in +x and +y directions in the "ready for swing phase mode" M6, so $F_x$ and $F_y$ both may have predetermined positive values.

Next, the compensation of mechanical impedance mode M2 is a mode in which the controller 400 controls the hip joint-drivers 210L and 210R and the knee-drivers 220L and 220R to compensate for friction at the joints or weight due to the gravity and negative feedback may be applied in a rectangular coordinate system. The joints can be controlled, as in the following Equation 8, in the ground impact absorbing mode M3.

$$\begin{bmatrix}\tau_{h,i}\\ \tau_{k,i}\end{bmatrix} = -J_{c,i}^{T}\begin{bmatrix}0 & 0\\ 0 & K_{d,y}\end{bmatrix}\dot{E}_{c,i}, \quad \text{[Equation 8]}$$

where $K_{d,y}$ is a virtual constant that is experimentally determined and the unit may be Nsec/deg.

Next, the ground impact absorbing mode M3 is a mode for controlling the drivers of the joints under the assumption that there is a virtual spring-damper in the longitudinal direction of each of the lines from the hip joints to the ends of the legs.

$$\begin{bmatrix}\tau_{h,i}\\ \tau_{k,i}\end{bmatrix} = -J_{p,i}^{T}\left(\begin{bmatrix}K_{p,r} & 0\\ 0 & 0\end{bmatrix}\Delta E_{p,i} + \begin{bmatrix}K_{d,r} & 0\\ 0 & 0\end{bmatrix}\Delta\dot{E}_{p,i}\right), \quad \text{[Equation 9]}$$

where $K_{p,r}$ and $K_{d,r}$ may be determined in advance in accordance with impedance measured at the legs of the wearer and the units are N/m and Nsec/m, respectively. Further, $\Delta E_{p,i}$ is the difference between the position of the end of a leg in the heel-strike state and the later position of the end of the leg in a polar coordinate system and $\Delta\dot{E}_{p,i}$ is the difference between a stop speed and the speed of the end of a leg in a polar coordinate system.

Next, the "ground impact absorbing & extension of virtual leg mode" M4 is a mode in which the controller 400 sets a balance point in the impedance control for the virtual legs as 0 degrees ($\theta_{p,i}$=0 in FIG. 9) and additionally vertically pulls the virtual legs while the mode M3 is performed, and the torque at the hip joint-drivers 210L and 210R and the knee-drivers 220L and 220R may be controlled as in the following Equation 10.

$$\begin{bmatrix}\tau_{h,i}\\ \tau_{k,i}\end{bmatrix} = J_{p,i}^{T}\left(\begin{bmatrix}K_{p,r} & 0\\ 0 & 0\end{bmatrix}\Delta E_{p,i} + \begin{bmatrix}K_{d,r} & 0\\ 0 & K_{p,\theta}\end{bmatrix}\Delta\dot{E}_{p,i}\right) \quad \text{[Equation 10]}$$

When $K_{p,\theta}$ is 0 in Equation 10, it becomes Equation 9. In Equation 10, $K_{p,\theta}$ is a value that is not 0 and the unit is N/deg.

Figure 10:
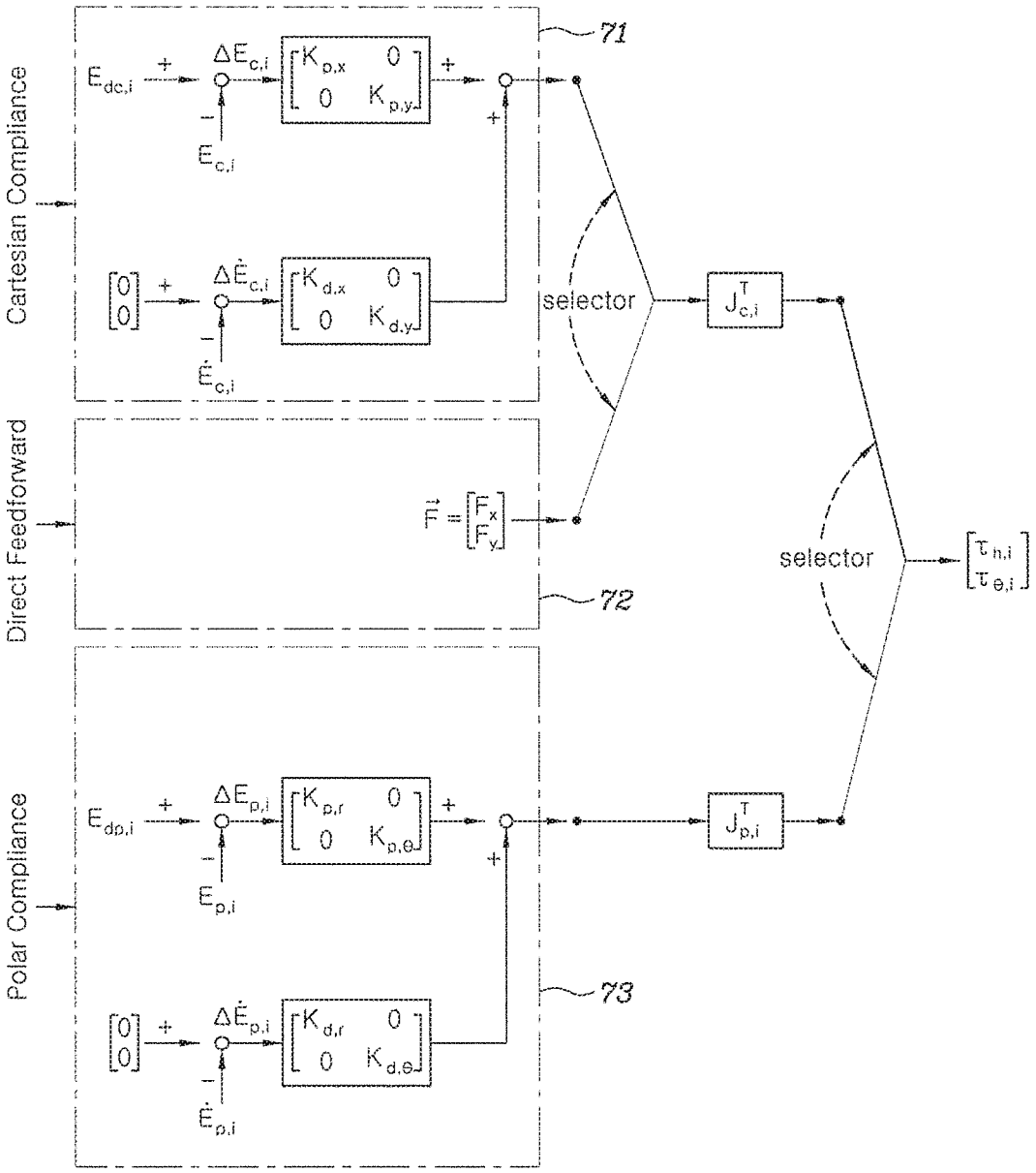
FIG. 10 is a view showing a control technique that is applied to a wearable walking assistant robot and a method for controlling the ankle-less walking assistant apparatus according to an exemplary embodiment in the present disclosure.

FIG. 10 is a view showing a control technique that is applied to an ankle-less walking assistant apparatus and a method for controlling the ankle-less walking assistant apparatus according to an exemplary embodiment in the present disclosure, in which the impedance control in a rectangular coordinate system indicated by '71' may be applied in the "compensation of mechanical impedance mode" M2, the direct feedforward control indicated by '72' may be applied in the "weight bearing mode" M1, the "pushing ground mode" M5, and the "ready for swing phase mode" M6, and the impedance control in a polar coordinate system indicated by '73' may be applied in the "ground impact absorbing mode" M3 and the "ground impact absorbing & extension of virtual leg mode" M4.

On the other hand, the present disclosure may determine whether a control mode changes (S15) to prevent a discontinuous section due to a sudden change of torque at the points where control modes change, and when it is determined that a control mode has changed, it is possible to perform control for interpolating the discontinuous torque of the joints (S16).

For the control for interpolating the discontinuous torque that is performed in the step S16, a technique in which a controller 400 applies a transition parameter, which changes from 0 to 1 along a sinusoidal path for a predetermined time interval, to previous control torque and new control torque may be used.

The transition parameter 'p' is expressed as in the following Equation 11 and control torque that is applied to a transition period using the transition parameter is expressed as in the Equation 12.

$$p = \sin\left(\frac{\pi}{2}SAT\left(\frac{t}{t_p}, 0, 1\right)\right) \quad \text{[Equation 11]}$$

$$\begin{bmatrix}\tau_{h,i}\\ \tau_{k,i}\end{bmatrix} = p\begin{bmatrix}\tau_{h,posterior}\\ \tau_{k,posterior}\end{bmatrix} + (1-p)\begin{bmatrix}\tau_{h,prior}\\ \tau_{k,prior}\end{bmatrix} \quad \text{[Equation 12]}$$

In Equations 11 and 12, $t_p$ is a predetermined time interval and SAT is a saturation function, in which SAT (x, a, b) has the value x for a<x<b, the value a for a<x, and the value b for x<b. Further, $\tau_{h,posterior}$ and $\tau_{k,posterior}$ are control torque at the hip joint-drivers 210L and 210R and the knee-drivers 220L and 220R in the changed control mode and $\tau_{h,prior}$ and $\tau_{k,prior}$ are control toque at the hip joint-drivers 210L and 210R and the knee-drivers 220L and 220R in the previous control mode before changed As described above, according to the ankle-less walking assistant apparatus and a method for controlling the ankle-less walking assistant apparatus, since ground-contact feet for supporting the ground are fixed to the ends of the calf links without a drivers for driving ankle joints, it is required to control drivers for the ankles of an exoskeleton robot, so the control algorithm can be simplified. Further, it is possible to remove the parts corresponding to ankle-drivers and feet connected the ankle-drivers from a robot, thus wearer discomfort due to excessive weight of the robot and restrictions in the degree of freedom when the robot is worn is removed, so the wearer can more easily walk.

Further, according to the ankle-less walking assistant apparatus and a method for controlling the ankle-less walking assistant apparatus of various exemplary embodiments of the present invention, it is possible to simply determine the gait phases of both a leg to be controlled and the other leg in accordance with load applied to the toe and the heel of the feet. Further, determined gait phases and predetermined walking modes are matched and then legs are controlled, so it is possible to ensure excellent walking assistance performance without a complicated calculation process.

Further, according to a walking assistant robot and a control method thereof of various exemplary embodiments, since it is possible to determine walking assistant force through simple Jacobian transform regardless of the number of axes, the applicable range is very wide.

The embodiments disclosed herein may be implemented in forms of a recording medium that stores commands executable by a computer. The commands may be stored in the form of a program code and may generate a program module and perform operations of the disclosed embodiments when executed by a processor. A recording medium may be implemented as a non-transitory computer-readable recording medium.

The computer-readable recording medium includes all types of recording media in which a command that may be decoded by a computer is stored. For example, the computer-readable recording medium may include a ROM, a RAM, a magnetic tape, a magnetic disk, a flash memory, and an optical data storage.

Although the present disclosure was described with reference to specific embodiments shown in the drawings, it is apparent to those skilled in the art that the present disclosure may be changed and modified in various ways without departing from the scope of the present disclosure, which is described in the following claims.

What is claimed is:

1. An ankle-less walking assistant apparatus comprising:
- a body supporting a back of a wearer;
- left and right hip joint-drivers extending from both sides of the body;
- left and right thigh links having first ends connected to the left and right hip joint-drivers, respectively;
- left and right knee-drivers connected to second ends of the left and right thigh links, respectively;
- left and right calf links having first ends connected to the left and right knee-drivers, respectively;
- ground-contact feet fixed to second ends of the left and right calf links, respectively;
- pressure sensors sensing pressure on both soles of the wearer; and
- a controller configured to:
  - determine a gait phase of a leg to be controlled and a gait phase of another leg based on pressure sensed by the pressure sensors,
  - select one of a plurality of control modes, which are set in advance, based on the determined gait phases, and
  - control the hip joint-drivers and the knee-drivers for the leg to be controlled according to the selected control mode,
- wherein the plurality of control modes includes a pushing ground mode,
- wherein in the pushing ground mode, the controller controls the hip joint-drivers and the knee-drivers to push an end of the leg to be controlled in −x and −y directions in a rectangular coordinate system, in which a front direction of the walking assistance apparatus is a +x direction and a direction vertically going away from the ground is a +y direction in the rectangular coordinate system.

2. The apparatus of claim 1, wherein the pressure sensors detect pressure applied to toes and heels of the soles.

3. The apparatus of claim 2, wherein the pressure sensors include:
- a first pressure sensor sensing pressure applied to the toes; and
- a second pressure sensor sensing pressure applied to the heels.

4. The apparatus of claim 2, wherein the controller determines that the toes and the heels are in contact with a ground when pressure applied to the toes and the heels is larger than a threshold pressure, and determines that the toes and the heels are not in contact with the ground when the applied pressure is smaller than the threshold pressure.

5. The apparatus of claim 4, wherein the controller:
- determines, as the gait phase, that the leg to be controlled or the another leg is supported on the ground throughout a sole when a corresponding toe is in contact with the ground and a corresponding heel is in contact with the ground,
- determines, as the gait phase, that the leg to be controlled or the another leg is supported on a corresponding toe on the ground when the corresponding toe is in contact with the ground and a corresponding heel is not in contact with the ground,
- determines, as the gait phase, that the leg to be controlled or the another leg is supported on a corresponding heel on the ground when a corresponding toe is not in contact with the ground and the corresponding heel is in contact with the ground, and
- determines, as the gait phase, that the leg to be controlled or the another leg is in air when both a corresponding toe and a corresponding heel are not in contact with the ground.

6. The apparatus of claim 1, wherein the plurality of control modes includes a weight bearing mode, and
- wherein in the weight bearing mode, the controller controls the hip joint-drivers and the knee-drivers to push the wearer in a gravity direction with a reference force.

7. The apparatus of claim 1, wherein the plurality of control modes includes a compensation of mechanical impedance mode, wherein in the compensation of mechanical impedance mode, the controller controls the hip joint-drivers and the knee-drivers to compensate for friction at the joints and weight of the apparatus due to gravity.

8. The apparatus of claim 1, wherein the plurality of control modes includes a ground impact absorbing and extension of virtual leg mode,
- wherein in the ground impact absorbing and extension of virtual leg mode, the controller sets a balance point in an impedance control direction for a virtual leg as 0 degrees and controls the hip joint-drivers and the knee-drivers so that the virtual leg is pulled to be vertically erected while making a virtual spring-damper in a longitudinal direction of the virtual leg and controlling the hip joint-drivers and the knee-drivers, using impedance control in order to absorb a shock from outside, and wherein the virtual leg is a line from the hip joints to ends of the ankle-less walking assistant apparatus.

9. The apparatus of claim 1, wherein the plurality of control modes includes a pushing ground mode, and wherein in the pushing ground mode, the controller controls the hip joint-drivers and the knee-drivers to push an end of the leg to be controlled in −x and −y directions in a rectangular coordinate system, in which a front direction of the walking assistant apparatus is a +x direction and a direction vertically going away from the ground is a +y direction in the rectangular coordinate system.

10. The apparatus of claim 1, wherein the plurality of control modes includes a ready for swing phase mode, and wherein in the ready for swing phase mode, the controller controls the hip joint-drivers and the knee-drivers to push an end of the leg to be controlled in +x and +y directions in a rectangular coordinate system for easy swing of the leg to be controlled, in which a front direction of the walking assistant apparatus is a +x direction and a direction vertically going away from the ground is a +y direction in the rectangular coordinate system.

11. The apparatus of claim 1, wherein when a control mode changes, the controller applies a transition parameter, which changes from 0 to 1 along a sinusoidal path for a reference time interval, to control torque applied to the hip joint-drivers and the knee-drivers in a previous control mode and to control torque to be applied to the hip joint-drivers and the knee-drivers in a new changed control mode.

12. The apparatus of claim 1, wherein each of the ground-contact feet has a curved surface, which is curved away from the ground in a walking direction, at a portion that comes in contact with the ground.

13. The apparatus of claim 1, wherein each of the ground-contact feet includes a rubber sole at a portion that comes in contact with the ground.

14. The apparatus of claim 1, wherein each of the left and right hip joint-drivers and the left and right knee-drivers include a motor or an actuator.

15. An ankle-less walking assistant apparatus, comprising:

a body supporting a back of a wearer;

left and right hip joint-drivers extending from both sides of the body;

left and right thigh links having first ends connected to the left and right hip joint-drivers respectively;

left and right knee-drivers connected to second ends of the left and right thigh links respectively;

ground-contact feet fixed to second ends of the left and right calf links respectively;

pressure sensors configured to sense pressure on both soles of the wearer; and a controller configured to:

determine a gait phase of a leg to be controlled and another leg based on the pressure sensed by the pressure sensors, select one of a plurality of control modes set in advance based on the determined gait phase, and control the hip joint-drivers and the knee-drivers for the leg to be controlled according to the selected control mode, wherein the plurality of control modes includes a ground impact absorbing mode, wherein in the ground impact absorbing mode, the controller makes a virtual spring-damper in a longitudinal direction of a virtual leg and controls the hip joint-drivers and the knee-drivers, using an impedance control in order to absorb a shock from outside, and wherein the virtual leg is a line from the hip joints to ends of the ankle-less walking assistant apparatus.

* * * * *